United States Patent [19]

Schmuck

[11] 4,415,038

[45] Nov. 15, 1983

[54] FORMATION PROTECTION VALVE APPARATUS AND METHOD

[75] Inventor: Phillip W. Schmuck, Spring, Tex.

[73] Assignee: Baker International Corporation, Orange, Calif.

[21] Appl. No.: 282,295

[22] Filed: Jul. 10, 1981

[51] Int. Cl.[3] ..... E21B 34/14

[52] U.S. Cl. ..... 166/373; 166/332; 166/324

[58] Field of Search ..... 166/324, 332, 334, 373, 166/374

[56] References Cited

U.S. PATENT DOCUMENTS

| | | | |
|---|---|---|---|
| 3,151,839 | 10/1964 | Mott | 166/334 |
| 3,306,363 | 2/1967 | McZilkey, Jr. | 166/334 |
| 3,703,193 | 11/1972 | Raulins | 166/324 |
| 3,799,204 | 3/1974 | Watkins et al. | 166/324 |
| 4,018,284 | 4/1977 | Perkins | 166/373 |
| 4,077,473 | 3/1978 | Watkins | 166/323 |
| 4,105,069 | 8/1978 | Baker | 166/332 |
| 4,230,185 | 10/1980 | Fredd | 166/332 |

*Primary Examiner*—Stephen J. Novosad

*Assistant Examiner*—William P. Neuder

*Attorney, Agent, or Firm*—William C. Norvell, Jr.

[57] ABSTRACT

A method and apparatus are provided for effecting the automatic closing of the bore of a subterranean well conduit upon the withdrawal of a tubular work string or production string from the conduit and the reopening of such bore upon the reinsertion of a tubular string. A biased shiftable valving element is held in an open position by an actuator sleeve which is operatively connected to an inserted tubular string so as to move with such string only a limited distance during either the insertion or the withdrawal movement thereof and permits the valving element to close when the inserted tubular string is withdrawn to prevent fluid remaining in the well from draining into the formation. When the shiftable valve is in a closed position, fluid conduit means divert any fluid pressure building up above the closed position of the valve to a piston element, disposed below the valve, which produces a force on the valve opposing the effects of such pressure build up and maintaining the valve in the closed position until the subsequent insertion of a tubular work string or production string.

26 Claims, 9 Drawing Figures

FORMATION PROTECTION VALVE APPARATUS AND METHOD

BACKGROUND OF THE INVENTION

1. Field of the Invention

The invention relates to a repeatedly operable valve that may be inserted in a conduit of a subterranean well and operated to a closed position upon the withdrawal of a tubular work string or production string from the well to protect the underlying formation from fluids contained in the well above the valve.

2. Description of the Prior Art

A number of operations are performed in the completion and maintenance of subterranean wells that require the introduction of fluids into the well and the production formation for specific purposes. For example, subsequent to gravel packing, completion fluids are introduced to the well to displace the fluid used during the gravel packing procedure. When the gravel packing and completion fluid introduction operations are completed, it is, of course, necessary to remove the mandrel and associated wash tube of the gravel packing apparatus and, in particular, the tubular work string carrying such apparatus, and substantial quantities of completion fluid are normally contained in the removed apparatus. It is, therefore, desirable to prevent the loss of such costly fluid by flow into the formation upon the removal of the tubular work string and the associated gravel packing apparatus from the well.

There is, therefore, a distinct need for a valve which may be inserted into the well above a production formation which will be automatically operable to an open position through the insertion of a work string or production string down to the production formation and automatically shifted to a closed position upon the removal of the work string or production string to prevent the loss of fluids contained in the well as the work string is removed.

SUMMARY OF THE INVENTION

The invention provides a formation protecting shiftable valve mounted within a valve housing which, in turn, is appropriately secured within a conduit of a subterranean well at a position above a production formation. An actuator sleeve is provided for moving the shiftable valve to and from a closed position with respect to the bore of the housing. The actuator sleeve has a direct connection to a pressure equalizing valve which is disposed below the main shiftable valve and is operable by the initial movement of the actuator sleeve in the valve opening direction to cause an equalization of pressure above and below the formation protecting shiftable valve. The actuator sleeve is operable by a pair of axially spaced collet arm arrays secured thereto which are respectively engaged with an inserted tubular string to cause the actuator sleeve to move a limited distance with such string before the collets disengage. Such engagement and limited co-movement occurs both during the insertion movement and the withdrawal movement of the tubular string, and, accordingly, the actuator sleeve functions to open the formation protecting shiftable valve upon the insertion of a tubular string into the well and to close such shiftable valve upon removal of the inserted tubular string from the well.

Since fluid pressures may build up above the formation protecting shiftable valve when it is in its closed position, fluid conduits are provided in the housing to conduct such fluid pressure to an annular fluid pressure chamber located below the formation protecting shiftable valve wherein it is applied to an annular piston which exerts a force on such shiftable valve to maintain it in its closed position despite the fluid pressure force exerted thereon.

BRIEF DESCRIPTION OF THE DRAWINGS

FIGS. 1B and 1C being vertical continuations of FIGS. 1A and 1B, respectively.

FIG. 2B being a vertical continuation of FIG. 2A.

DESCRIPTION OF THE PREFERRED EMBODIMENTS

Figure 1A:
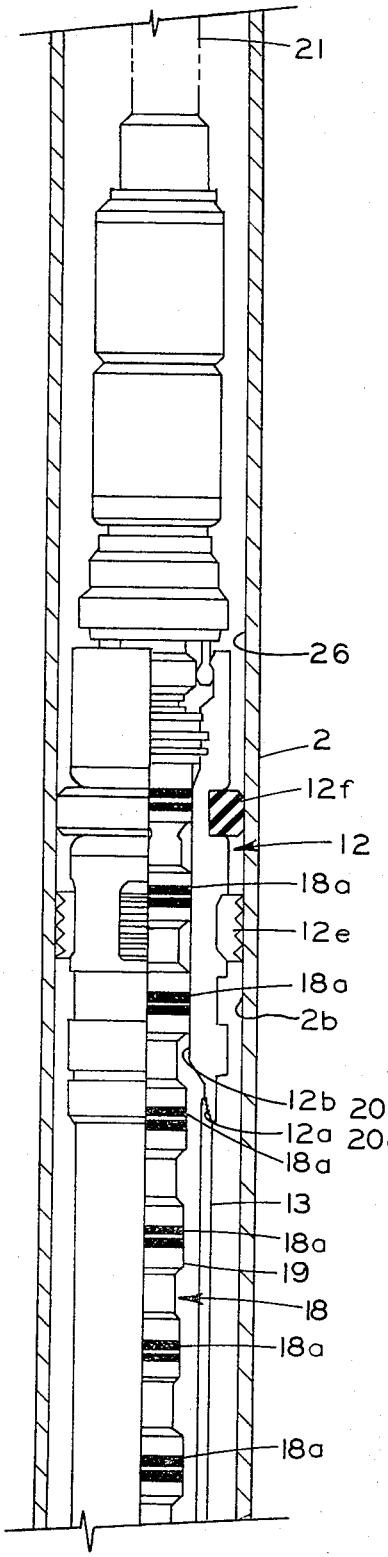
FIGS. 1A, 1B and 1C collectively constitute a schematic vertical sectional view of a complete gravel packing apparatus inserted in a subterranean well casing, which incorporates a formation protection valve embodying this invention.
Figure 1B:
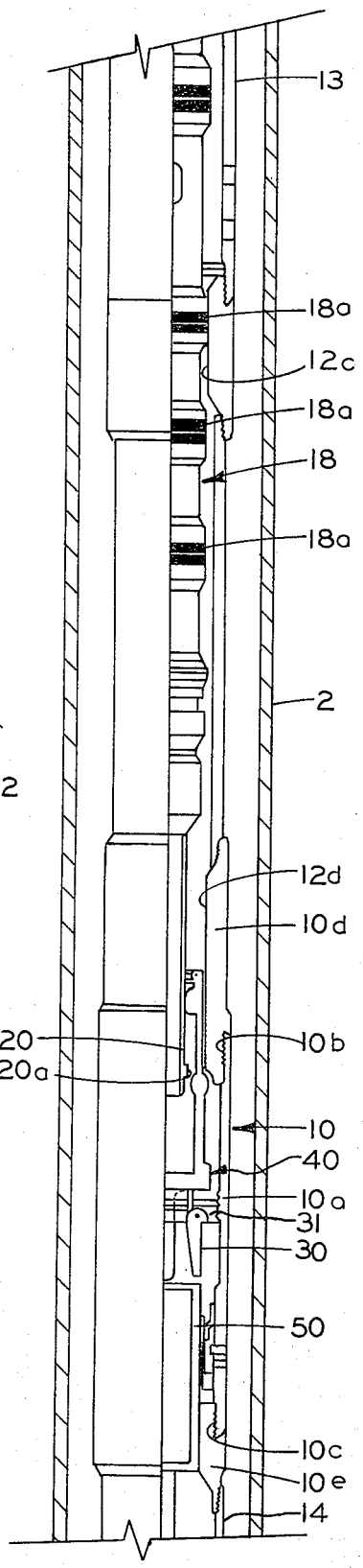
Figure 1C:
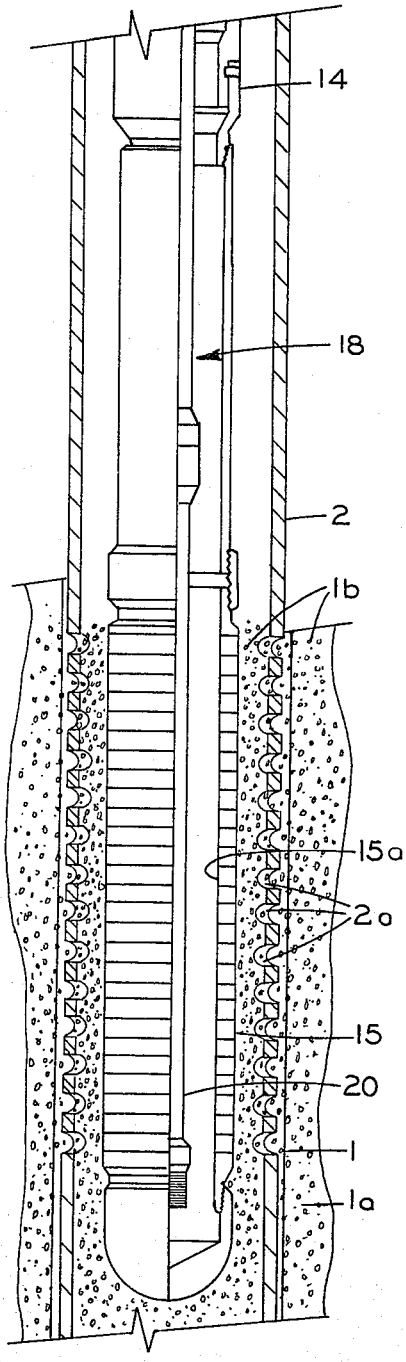

Referring to FIGS. 1A, 1B and 1C, the numeral 1 designates a well bore having a production formation 1*a*. A conduit, such as casing 2, is inserted into well bore 1 and provided with perforations 2*a* in conventional fashion. Within the casing 2 a formation protection valve housing 10 is mounted by any conventional form of seal, such as packer 12, which is expanded to achieve a rigid sealed engagement with the internal bore 2*b* of the casing 2.

Valve housing 10 may comprise one of a plurality of threadably interconnected tubular elements, such as a conventional perforated extension sleeve 13, a conventional shear out safety joint 14, and a conventional screen assembly 15, all of which are suspended from the internal threads 12*a* provided in the packer 12.

Valve housing 10 is preferably located just above the shear out safety joint 14. Valve housing 10 includes a central elongated sleeve portion 10*a* having internal threads 10*b* and 10*c* respectively connecting to an upper connector sub 10*d* and a lower connector sub 10*e*.

As shown in FIGS. 1A–1C, a conventional gravel packing mandrel 18, including a cross over portion 19 and a wash pipe 20 (FIG. 1C), is inserted through the bore defined by packer 12 and the tubular elements depending therefrom, including the protector valve housing 10. The wash pipe 20 extends to a position within the bore 15*a* of the screen 15.

The gravel packing apparatus thus assembled may comprise any one of several well known types, such as for example, the gravel packing assembly described and illustrated on pages 6 and 7 of the Baker Sand Control Catalog, 1980–1981, published by Baker International Corporation of Houston, Tex. As is well known to those skilled in the art, such gravel packing apparatus is suspended from a tubular work string 21 and includes expansible slips 12e and an expansible seal 12f for secure sealing engagement with the bore 2b of casing 2. Such apparatus further includes seal bores 12b and 12c formed in the serially connected housings previously mentioned for cooperation with axially spaced sealing elements 18a provided on the inserted cross-over mandrel 18.

The operation of such gravel packing apparatus is entirely conventional. Its function is to provide a packing of gravel 1b around the annulus defined between the screen 15 and the casing bore 2b and also in the casing perforations 2a and the surrounding perforations in the production formation 1a. When the tubular work string 21 is elevated out of the well, all of the residual completion fluid contained therein would drain into the production formation and would entail an economic loss of relatively expensive fluid.

Figure 3A:
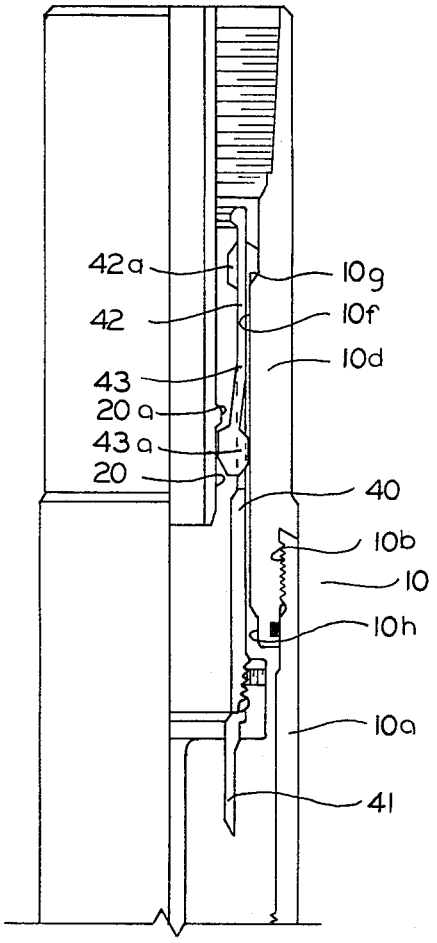
FIGS. 3A and 3B are views similar to FIGS. 2A and 2B but showing the elements of the formation protection valve in their closed position, following the withdrawal of the gravel packing tubing string from the well.
Figure 3B:
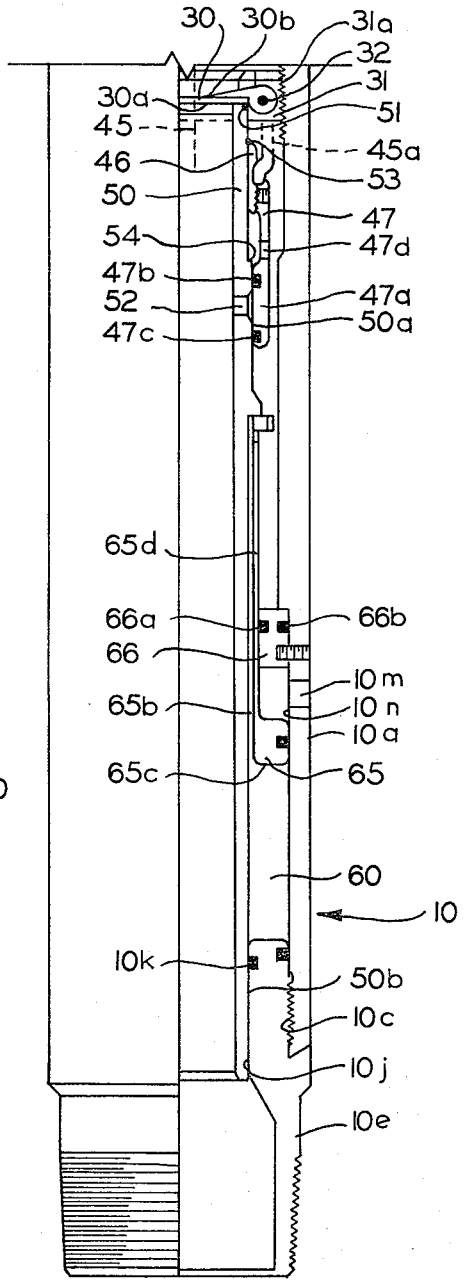

To prevent such adverse effects, this invention provides a shiftable valve 30 which is appropriately mounted on a valve mounting ring 31 which is secured by threads 31a to the interior of the sleeve portion 10a of the formation protection valve housing 10. This valve 30 is actuated to a closed position, as illustrated in FIG. 3B, upon the withdrawal of the gravel packing mandrel 18 from the well. At the same time, the valve 30 may be readily reopened upon the reinsertion of a production string or another tubular work string and, hence, the valve is capable of many repeated operations and will repeatedly perform its functions throughout the life of the valve.

While not limited thereto, the shiftable valve 30 preferably comprises a flapper valve which is horizontally pivotally mounted in the valve support ring 31 by a horizontal pin 32. A suitable torsion spring (not shown) biases valve 30 to its horizontal closed position illustrated in FIG. 3B and it is thus apparent that the shiftable movement of the valve 30 is in a vertical plane.

Figure 2A:
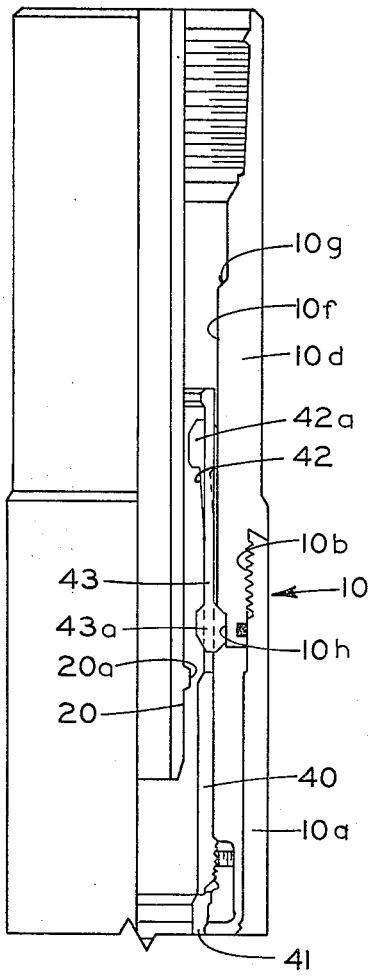
FIGS. 2A and 2B collectively constitute an enlarged scale, quarter sectional view of the formation protection valve embodying this invention that is incorporated in the apparatus of FIGS. 1A, 1B and 1C, with the elements of the valve shown in their fully open position.
Figure 2B:
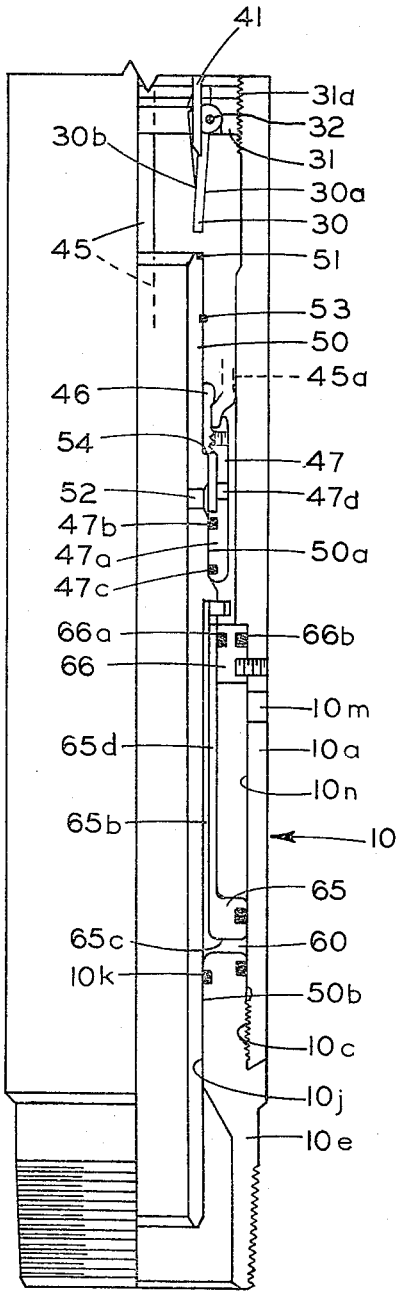

When the valve 30 is in its fully opened position, as illustrated in FIGS. 2A and 2B, it is held in such position against the bias of the torsion spring by an axial extension arm 41 provided on the bottom of an actuating sleeve 40, which is mounted for slidable movement within the bore 10f of the upper connector 10d of the protector valve housing 10. The upper portion of the actuating sleeve 40 is provided with two axially spaced, peripheral arrays of collet arms 42 and 43, respectively. These arrays have enlarged end portions 42a and 43a, respectively, and are inherently spring biased in a radially outward direction, so as to maintain contact with the adjacent bore surface 10f of the upper housing connector sub 10d. Connector hub 10d is provided with two axially spaced annular recesses 10g and 10h which respectively cooperate with the enlarged end portions 42a and 43a of the collet arms 42 and 43. The vertical spacing of the recesses 10g and 10h exceeds that of the collet arm end portions 42a and 43a so that only one set of such enlarged end portions may be in engagement with one of the recesses 10g or 10h at any given time.

In the open position of the valve 30, as illustrated in FIGS. 2A, the lower set of enlarged end portions 43a of collet arms 43 are in engagement with the lower recess 10h. This inherently means that the upper enlarged portions 42a of collet arms 42 are forced to an inwardly projecting position by the bore surface 10f of the upper housing connector sub 10d. Thus, as the end of an inserted wash pipe, tubing string or production string is pulled upwardly out of the well, an external shoulder portion, such as shoulder 20a on wash pipe 20, will engage the enlarged collet end portions 42a of the collet arms 42 and, thus, effect an upward movement of the actuating sleeve 40. Such upward movement is, however, limited, for as soon as the enlarged end portions 42a reach a position opposite the upper recess 10g in the housing connector sub 10d, the enlarged end portions 42a of the collet arms 42 will snap into such recess and will clear the enlarged shoulder 20a provided on the end of the inserted tubing string, here the wash pipe 20. Such limited upward movement is, however, sufficient to permit the flapper valve 30 to swing vertically upward to its closed position illustrated in FIG. 3B, where it is stopped by engagement with the bottom surface of valve support ring 31.

To achieve a more secure sealing of the flapper valve 30, an elongated seal supporting tube 50 is mounted in the lower portions of the protector valve housing 10 for slidable movements relative thereto. Thus, the bottom portions of seal support tube 50 are slidably engaged by the internal bore surface 10j of the bottom connector sub 10e, and a fluid seal is achieved between such sliding surfaces through the provision of a seal 10k conventionally provided in the internal surface of the bore 10j. The upper surface of the seal support tube 50 or annular valve seat is channeled to provide a mounting for an annular elastomeric seal element 51 which, when the seal support tube 50 is elevated, achieves a sealing engagement with the bottom surface 30a of the flapper valve 30 (FIG. 3B).

To move the seal support tube 50 upwardly, the actuating sleeve 40 is provided at its lower end with two axially extending arms 45 (of which only one is shown in the drawings), which extend through appropriate recesses (not shown) provided in the periphery of the flapper valve support ring 31. The lower ends 45a of the arms 45 are appropriately secured to a ring 46 which, in turn, is threadably secured to the upper portion of an annular pressure equalizing valve 47. Valve 47 is provided with an inwardly thickened bottom portion 47a in which two vertically spaced annular seals 47b and 47c are respectively mounted. Above the seal 47b, a radial port 47d is provided in valve 47. The pressure equalizing valve 47 is slidable on the external cylindrical periphery 50a of the tube 50 and a radial port 52 is provided in such tube adjacent the path of movement of the equalizing valve 47. Thus, in the open position of the formation protection valve 30, the seals 47b and 47c are both disposed below the port 52, and fluid communication is established between the interior of the tube 50 upwardly through the annular space surroundig the tube 50, through the vertical openings provided in the support ring 31 to accommodate the extension arms 45, to the region above the formation protection valve 30. When such valve is in a closed position, this permits pressure equalization on the top and bottom sides of the valve 30 prior to effecting the opening movement thereof in a manner to be hereinafter described.

The ring 46 carried by the bottom ends of the extension arms 45 is provided with a lost motion connection with the tube 50 by virtue of a stop ring 53 located on the periphery of tube 50 but spaced above the ring 46. Thus, the actuating sleeve 40 must be moved upwardly a significant distance, permitting the formation protection valve 30 to swing upwardly to its closed position before the seal mounting tube 50 is engaged by the actuator assemblage 40, and moved upwardly thereby.

At the same time that the upward movement of the actuator sleeve 40 by the removal movement of the inserted tubing string is completed, the seal support 50 will be moved upwardly sufficient to bring the elastomeric seal 51 into sealing engagement with the bottom surface 30*a* of the flapper valve 30. The same upward movement of the actuator 40 provides, by virtue of the lost motion connection with the seal mounting tube 50, a movement of the pressure equalizing valve 47 to the position illustrated in FIG. 3B wherein the seals 47*b* and 47*c* now straddle the radial port 52 in the seal support tube 50 and prevent fluid communication through such port when the region above the flapper valve 30. Thus, any fluids contained in the inserted tubing string, such as a gravel packing mandrel 18, are effectively blocked from bleeding out of the inserted tubing string and reaching the production formation 1*a*.

Figure 4A:
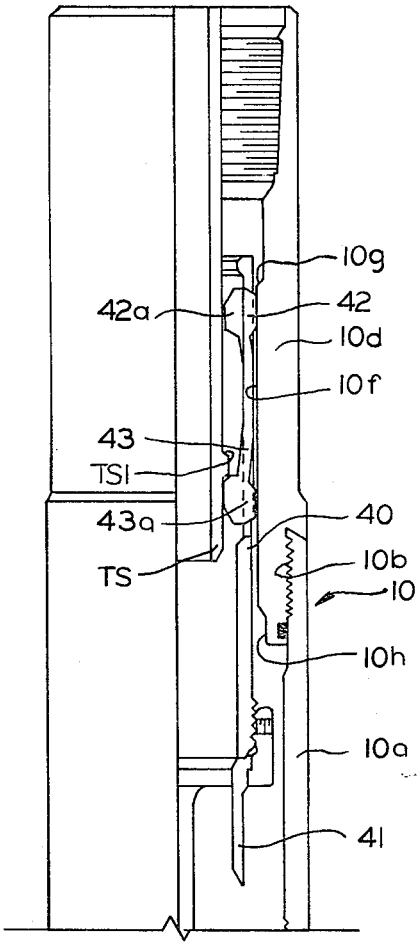
FIGS. 4A and 4B are views similar to FIGS. 3A and 3B, but showing an intermediate pressure equalization position assumed by some of the valve elements during the reopening of the valve by the subsequent insertion of a work string or production tubing.
Figure 4B:
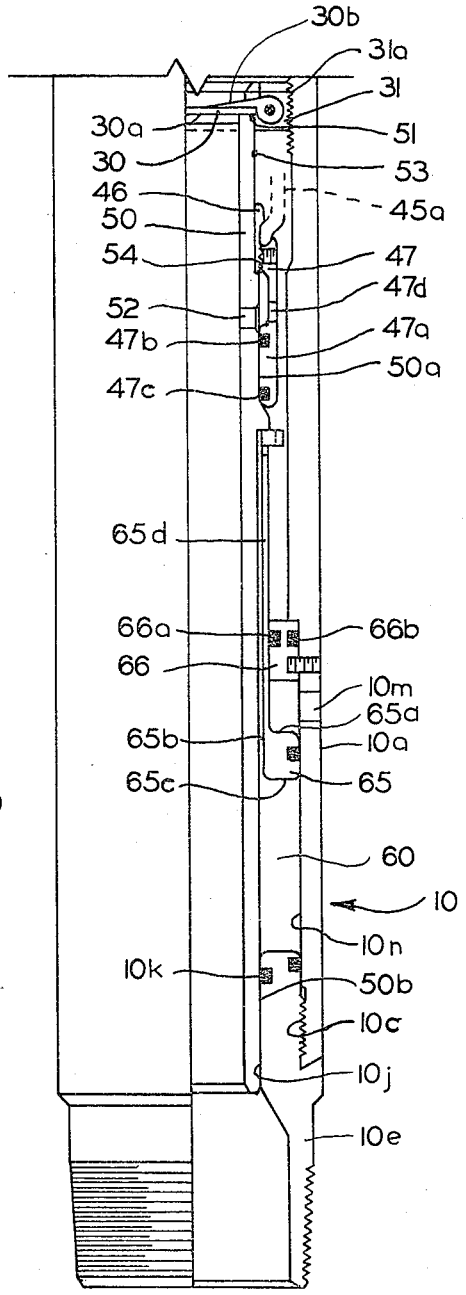

As previously stated, the formation protection valve embodying this invention is capable of repreated usage. Referring now to FIGS. 4A and 4B, the first steps involved in the reopening of the formation protection valve 30 will be described. In this figure, the tubing string TS, which may be a work string or a production string, is inserted downwardly through the housing 10. Such string has a peripheral shoulder TS1. The projecting shoulder TS1 freely passes the upper enlarged collet portions 42*a* but does engage the inwardly projecting, lower enlarged collet portions 43*a* and, thus, initiates a downward movement of the actuating sleeve 40. The initial effects of such downward movement, due to the lost motion connection between the actuator sleeve 40, and the seal support tube 50, is to effect a downward movement of the pressure equalizing valve element 47 to the position shown in FIG. 4B wherein the seals 47*b* and 47*c* are both disposed below the radial port 52 provided in the seal support tube 50. Thus, pressure is effectively equalized above and below the flapper valve 30 even though it is still in its closed and sealed position.

At the end of the lost motion movement of the ring 46 of actuator sleeve 40, the bottom surface of ring 46 contacts a shoulder 54 formed on the periphery of the support tube 50 and starts the support tube 50 moving downwardly, breaking the seal between the annular elastomeric seal 51 and the bottom face 30*a* of the flapper valve 30. After additional downward movement of the actuator 40, the flapper valve retaining finger 41 engages the top surface 30*b* of flapper valve 30 and pivots it downwardly to its fully open position shown in FIG. 2B and retains it in such position. At the same instant that the flapper valve 30 is shifted to its fully opened position, the enlarged end portions 43*a* of the lower collet array 43 become aligned with the annular recess 10*h* and snap into such recess, thus, freeing the inserted tubing string TS from the actuator sleeve 40 and interrupting further downward movement of such actuator sleeve. Thereafter, the inserted tubing string TS may be moved downwardly to whatever extent is desired, since there is nothing to impede further movement downwardly through the housing 10, to restore the apparatus to the condition illustrated in FIGS. 2A and 2B which has previously been described.

It sometimes happens that when the production formation valve 30 is in its closed position, fluid pressure will build up above such valve. If this pressure becomes sufficiently large to overcome the mechanical locking of the actuator sleeve represented by spring tension engagement of the enlarged upper arm portions 47*a* of the collet array 47, it is conceivable that the production formation valve 30 could be shifted to a partially opened position by such increase in pressure. To prevent this contingency, an annular fluid pressure chamber 60 is defined between the interior bore 10*n* of the housing sleeve 10*a* and the exterior surface 50*b* of the seal supporting tube 50. An annular piston 65 is mounted in such annular pressure chamber 60 for vertically slidable movements therein. The top surface 65*a* of annular piston 65 is vented to formation pressure through a radial port 10*m* provided in the wall of housing sleeve portion 10*a*. A sealing ring 66 is suitably secured to the internal surface of housing sleeve 10*a* and provided with seals 66*a* and 66*b*, respectively engaging the internal walls of sleeve portion 10*a* and the external surface of an extension sleeve 65*d* formed on the annular piston 65. The internal diameter of extension sleeve 65*d* is somewhat greater than the external diameter of the seal support tube 50, so that fluid pressure which flows downwardly around the periphery of the valve supporting ring 31, may pass freely through the annular space 65*b* thus defined to impinge upon the lower face 65*c* of piston 65.

The total area of piston face 65*a* is designed to be in excess of the upwardly facing area of the flapper valve 30, so that a resultant upward force is exerted by the piston 65 against the seal support tube 50, thus maintaining the elastomeric seal 51 carried by the top face of such tube in sealing relationship with the underface 30*a* of the flapper valve 30. The integrity of the system is thus maintained despite any increase in fluid pressure above the closed flapper valve 30.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A repeatedly operative valve for positioning in a conduit of a subterranean well, comprising: a tubular housing; an annular valve seat secured within said housing; a shiftable valve element cooperable with said annular valve seat to open or close the bore thereof, said valve element being resiliently urgable to a bore closing position; and actuator sleeve mounted in said tubular housing for vertical movements relative thereto and being operatively associated with said valve element; and means on said actuator sleeve engageable with an inserted tubing string for limited axial co-movement therewith during both insertion and retraction movements of said inserted tubing string, the resulting limited movement of said actuator sleeve in one direction producing movement of said valve element to a bore opening position and the resulting limited movement of said actuator sleeve in the opposite direction permitting said valve element to move to the bore closing position said actuator sleeve being provided with extension arms passing downwardly through the outer portions of said annular valve seat, and pressure equalizing valve means connected to the lower portions of said extension arms, said pressure equalizing valve means being exposed on one side to fluid pressure within the conduit below said annular valve seat on the other side to the fluid pressure above said annular valve seat, said pressure equalizing valve means being closed by the initial movement of said actuator in one direction and opened by the initial movement of said actuator in the other direction, thereby equalizing pressure on said valve element prior to opening thereof.

2. The valve of claim 1 wherein said actuator sleeve is provided with extension arms passing downwardly through the outer portions of said annular valve seat, a seal mounting tube slidably supported in said housing below said annular valve seat for axial movements, an annular elastomeric seal mounted on the top surface of said tube and sealingly engageable with said valve element when said valve element is in its bore closing position and said tube is elevated, and lost motion connection means between said tube and said extension arms to move said tube upwardly to said sealing position only during the initial movement of said actuator sleeve in the other direction.

3. The valve defined in claim 2 wherein said seal mounting tube has a radially disposed pressure equalizing port in its side wall, a valving member movable into and out of sealing engagement with said pressure equalizing port, and means connecting said extension arms to said valving member to move said valving member to its sealing position relative to said pressure equalizing port by the initial movement of said actuator sleeve in one direction, and to open said pressure equalizing port by the initial movement of said actuator sleeve in the other direction.

4. The valve defined in claim 2 wherein fluid conduit means are provided to direct the fluid pressure existing above the closed valve element to a level below said valve element, and piston means responsive to said fluid pressure for urging said seal mounting tube in a direction to provide additional sealing force on said annular elastomeric seal.

5. The valve defined in claim 2 wherein a portion of said seal mounting tube cooperates with said housing to define an annular fluid pressure chamber, fluid passage means for transmitting fluid pressure existing above said valve element when closed to said annular fluid pressure chamber, and an annular piston disposed in said annular fluid pressure chamber, said annular piston being operatively connected to said tube to urge said seal mounting tube in a direction by the fluid pressure existing in said annular fluid pressure chamber to provide additional sealing force to said annular elastomeric seal.

6. The valve of claim 1 wherein said valve element comprises a flapper pivotally mounted relative to said annular valve seat for movement in a vertical plain between said bore opening and closing positions.

7. A repeatably operable valve for mounting in a conduit for a subterranean well, comprising: a tubular housing; an annular valve support secured within said conduit; a flapper valve pivotally mounted to the lower portion of said annular valve support for movement in a vertical plane between an upper horizontal position closing the bore opening of said annular valve support and a lower vertical position opening said bore opening; a seal mounting tube slidably mounted in said housing below said annular valve support; an annular elastomeric seal element mounted in the upper face of said seal mounting tube and being engageable by upward movement of said tube with the bottom face of said flapper valve when said flapper valve is in its said horizontal bore closing position; an actuator sleeve mounted in said tubular housing above said annular valve support for vertical movements relative thereto, said actuator sleeve having a first axial extension passing downwardly through the periphery of said annular valve support; means for operatively connecting the lower portion of said first axial extension of said actuator sleeve to said seal mounting tube; a second downwardly projecting axial extension formed on said actuator sleeve and engageable with the upper surface of said flapper valve to shift said flapper valve downwardly to its said bore opening position after downward movement of said actuator sleeve has been initiated, whereby said seal mounting tube is moved out of the path of opening movement of said flapper valve prior to engagement of said flapper valve by said second axial extension; and means on said actuator sleeve engageable with an inserted tubing string for limited axial comovement therewith during both insertion and retraction movement of an inserted tubing string relative to said tubular housing, the resulting limited downward movement of said actuator sleeve producing movement of said flapper valve to said bore opening position and the resulting limited upward movement of said actuator sleeve permitting said flapper valve to move to said bore closing position.

8. The valve of claim 7 wherein said seal mounting tube has a radially disposed pressure equalizing port in its side wall, an annular valving member axially movable into and out of sealing engagement with said pressure equalizing port, and means connecting said first axial extension of said actuating sleeve to said valving member to move said valving member to its sealing position relative to said pressure equalizing port by the initial downward movement of said actuator sleeve, and to open said pressure equalizing port by the initial upward movement of said actuator sleeve.

9. The valve defined in claim 7 wherein fluid conduit means are provided to direct fluid pressure existing above the flapper valve in its closed position to a level below said flapper valve, and means responsive to said fluid pressure for urging said seal mounting tube upwardly to provide additional sealing force on said flapper valve.

10. The valve defined in claim 7 wherein a portion of said seal mounting tube cooperates with said housing to define an annular fluid pressure chamber within said housing, fluid passage means for transmitting fluid pressure existing above said flapper valve when in its closed position to said annular fluid pressure chamber, and an annular piston disposed in said annular fluid pressure chamber, said annular piston being operatively connected to said seal mounting tube to urge said tube upwardly by the fluid pressure existing in said annular fluid pressure chamber to provide additional sealing force to said flapper valve.

11. The valve defined in claim 1, wherein said means on said actuator sleeve engageable with an inserted tubing string for limited axial co-movement therewith comprises a first peripheral array of collet arms having enlarged end portions spring-biased outwardly to engage in a first annular recess provided in said housing, a second peripheral array of collet arms having enlarged end portions spring-biased outwardly to engage in a second annular recess formed in the inner wall of said housing, the axial spacing between said first and second annular recesses being substantially in excess of the axial spacing between the enlarged end portions of the first and second arrays of collet arms, whereby when one set of said enlarged end portions of the collet arms arrays is engaged in one said housing annular recess, said enlarged end portions of the other annular array of collet arms are projecting inwardly into the path of an annular projection provided on an inserted tubing string, and whereby said actuator sleeve is moved either upwardly or downwardly by an inserted tubing string for only a limited distance.

12. In a subterranean well having a perforated casing adjacent a production zone, a seal member sealably securable along said casing above the production zone and carrying a depending tubular housing assembly including a screen deposed within the perforated zone of the casing, and a gravel packing wash pipe and cross over tube removably inserted within said depending tubular housing for effecting the gravel packing of the production formation and screen, the improvement comprising: a tubular valve housing connectable in said depending housing assembly in series relationship at a position above said screen; an annular valve seal secured within said tubular valve housing; a shiftable valve element cooperable with said annular valve seat to open or close the bore thereof: said valve element being resiliently urgable to a bore closing position; an actuator sleeve mounted within said tubular housing for vertical movements relative thereto and being operatively associated relative to said valve element; and means on said actuator sleeve engageable with the inserted wash pipe for limited axial co-movement therewith during both insertion and retraction movements of the inserted wash pipe, the resulting limited downward movement of said actuator sleeve producing movement of said valve element to a bore opening position and the resulting limited upward movement of said actuator sleeve permitting said valve element to move to the bore closing position, said actuator sleeve being provided with extension arms passing downwardly through the outer portions of said annular valve seat, the seal mounting tube slidably supported in said housing below said annular valve seat for axial movements, and annular elastomeric field mounted on the top surface of said tube and sealingly engageable with said valve element when said valve element is in its bore closing position and said tube is elevated, and lost motion connection means between said tube and said extension arms to move said tube upwardly to said sealing position only during the final upward movement of said actuator sleeve.

13. The valve of claim 12 wherein said operative connection between said actuator sleeve and said valve element comprises a lost motion connection permitting initial movement of said actuator sleeve in a valve opening direction without moving said valve element relative to said annular valve seat, and means responsive to said initial movement of said actuator sleeve in a valve opening direction for equalizing pressures above and below said valve element.

14. In a subterranean well having a perforated casing adjacent a production zone, a seal member sealably securable along said casing above the production zone and carrying a depending tubular housing assembly including a screen disposed within the perforated zone of the casing, and a gravel packing wash pipe and cross over tube removably inserted within said depending tubular housing for effecting the gravel packing of the production formation and screen, the improvement comprising: a tubular valve housing connectable in said depending housing assembly in series relationship at a position above said screen; an annular valve seat secured within said tubular valve housing; a shiftable valve element cooperable with said annular valve seat to open or close the bore thereof; said valve element being resiliently urgable to a bore closing position; an actuator sleeve mounted within said tubular housing for vertical movements relative thereto and being operatively associated relative to said valve element; and means on said actuator sleeve engageable with the inserted wash pipe for limited axial co-movement therewith during both insertion and retraction movements of the inserted wash pipe, the resulting limited downward movement of said actuator sleeve producing movement of said valve element to a bore opening position and the resulting limited upward movement of said actuator sleeve permitting said valve element to move to the bore closing position, said actuator sleeve being provided with extension arms passing downwardly through the outer portions of said annular valve seat, a seal mounting tube slidably supported in said housing below said annular valve seat for axial movements, an annular elastomeric seal mounted on the top surface of said tube and sealingly engageable with said valve element when said valve element is in its bore closing position and said tube is elevated, and lost motion connection means between said tube and said extension arms to move said tube upwardly to said sealing position only during the final upward movement of said actuator sleeve.

15. The valve defined in claim 12 wherein said tube has a radially disposed pressure equalizing port in its side wall, a valving member movable into and out of sealing engagement with said pressure equalizing port, and means connecting said extension arms to said valving member to move said valving member to its sealing position relative to said pressure equalizing port by the initial upward movement of the actuator sleeve, and to open said pressure equalizing port by the initial downward movement of said actuator sleeve.

16. The valve defined in claim 12 wherein fluid conduit means are provided to divert the fluid pressure existing above the closed valve element to a level below said valve element, and piston means responsive to said diverted fluid pressure for urging said seal mounting tube upwardly to provide additional force on said annular elastomeric seal.

17. The valve defined in claim 12 wherein a portion of said seal mounting tube cooperates with said tubular valve housing to define an annular fluid pressure chamber fluid passage means for transmitting fluid pressure existing above said valve element when closed to said annular fluid pressure chamber, and an annular piston disposed in said annular fluid pressure chamber, said annular piston being operatively connected to said tube to urge said seal mounting tube upwardly by the fluid pressure existing in said annular fluid pressure chamber to provide additional sealing force to said annular elastomeric seal.

18. The valve of claim 12 wherein said valve element comprises a flapper pivotally mounted to said annular valve seat for movement in a vertical plane between said bore opening and closing positions.

19. The method of isolating a production formation in a subterranean well from fluids contained in the well during the withdrawal of such tubing string from the well, comprising the steps of: mounting a shiftable valve in the well in a position above the formation to be protected, said valve being movable between an upper position preventing fluid flow downwardly through the well and a lower position permitting unimpeded fluid flow; utilizing the withdrawal movement of the inserted tubing string to shift the shiftable valve element to its said closed position; diverting any fluid pressure existing above the closed shiftable valve to a fluid pressure chamber disposed below the closed fluid valve; and applying the diverted fluid pressure to increase the upward closing force on said valve in response to the said fluid pressure existing above the valve.

20. The method of isolating a production formation in a subterranean well from fluids contained in the well during the withdrawal of such tubing string from the well casing, comprising the steps of: mounting a shiftable valve in the well in a position above the formation to be protected, said valve being movable between an upper position preventing fluid flow downwardly through the well and a lower position permitting unimpeded fluid flow; utilizing the withdrawal movement of the inserted tubing string to shift the shiftable valve element to its said closed position; diverting any fluid pressure existing above the closed shiftable valve to a fluid pressure chamber disposed below the closed fluid valve; applying the diverted fluid pressure to increase the upward closing force on said valve in response to the said fluid pressure existing above the valve; and utilizing the subsequent insertion movement of the inserted tubing string to shift the shiftable valve element to its said lower position.

21. An apparatus insertable within a subterranean well having a conduit therein extending to a productive zone, comprising: a seal member sealingly securable along said conduit above the productive zone; a tubular housing assembly depending from said seal member; a ported member carried on said tubular housing assembly and positionable adjacent said zone; a gravel packing wash pipe and cross-over tube removably inserted within said tubular housing for effecting the gravel packing of the productive zone around said ported member; a tubular valve housing connectable in said housing assembly in series relationship at a position above said ported member; an annular valve seat secured within said tubular valve housing; a shiftable valve element cooperable with said annular valve seat to open or close the bore thereof, said valve element being resiliently urgable to a bore closing position; an actuator sleeve mounted within said tubular housing for vertical movements relative thereto and being operatively associated relative to said valve element; and means on said actuator sleeve engageable with the inserted wash pipe for limited axial co-movement therewith during both insertion and retraction movements of the inserted wash pipe, the resulting limited movement of said actuator sleeve in one direction producing movement of said valve element to a bore opening position and the resulting limited movement of said actuator sleeve in the opposite direction permitting said valve element to move to the bore closing position, said actuator sleeve being provided with extension arms passing downwardly through the outer portions of the annular valve seat and pressure equalizing valve means connected to the lower portions of said extension arms, said pressure equalizing valve means being exposed on one side to fluid pressure within the conduit below said annular valve seat and on the other side to the fluid pressure above said annular valve seat, said pressure equalizing valve being closed by the final movement of said actuator in said one direction and opened by the initial movement of said actuator in said opposite direction, thereby equalizing pressure on said valve element prior to opening thereof.

22. The apparatus of claim 21 wherein said operative connection between said actuator sleeve and said valve element comprises a lost motion connection permitting initial movement of said actuator sleeve in a valve opening direction without moving said valve element relative to said annular valve seat, and means responsive to said initial movement of said actuator sleeve in a valve opening direction for equalizing pressures above and below said valve element.

23. The apparatus of claim 21 wherein said actuator sleeve is provided with the extension arms passing downwardly through the outer portions of said annular valve seat, a seal mounting tube slidable supported in said housing below said annular valve seat for axial movements, an annular elastomeric seal mounted on the top surface of said seal mounting tube and sealingly engageable with said valve element when said valve element is in its bore closing position and said tube is elevated, and lost motion connection means between said tube and said extension arms to move said tube upwardly to said sealing position only during the final upward movement of said actuator sleeve.

24. The apparatus of claim 23 wherein said seal mounting tube has a radially disposed pressure equalizing port in its side wall, a valving member movable into and out of sealing engagement with said pressure equalizing port, and means connecting said extension arms to said valving member to move said valving member to its sealing position relative to said pressure equalizing port by the initial movement of said actuator in said one direction, and to open said pressure equalizing port by the initial movement of said actuator sleeve in said opposite direction.

25. The apparatus of claim 21 wherein fluid conduit means are provided to divert the fluid pressure existing above the closed valve element to a level below said valve element, and piston means responsive to said diverted fluid pressure for urging said seal mounting tube upwardly to provide additional force on said annular elastomeric seal.

26. The apparatus of claim 21 wherein a portion of said seal mounting tube cooperates with said tubular valve housing to define an annular fluid pressure chamber fluid passage means for transmitting fluid pressure existing above said valve element when closed to said annular fluid pressure chamber, and an annular piston disposed in said annular fluid pressure chamber, said annular piston being operatively connected to said tube to urge said seal mounting tube upwardly by the fluid pressure existing in said annular fluid pressure chamber to provide additional sealing force to said annular elastomeric seal.

* * * * *